US005979099A

United States Patent [19]

Kervin

[11] Patent Number: 5,979,099

[45] Date of Patent: Nov. 9, 1999

[54] TRUCK MOUNTABLE SHOOTING REST

[76] Inventor: Durham L. Kervin, 704 Laurel Wood Dr. E., Satsuma, Ala. 36572

[21] Appl. No.: 09/067,988

[22] Filed: Apr. 29, 1998

[51] Int. Cl.[6] ..... F41A 27/30

[52] U.S. Cl. ..... 42/94

[58] Field of Search ..... 42/94; 89/37.01, 89/37.04

[56] References Cited

U.S. PATENT DOCUMENTS

| | | | |
|---|---|---|---|
| 3,012,350 | 12/1961 | Wold | 42/94 |
| 3,225,656 | 12/1965 | Flaherty et al. | 42/94 |
| 3,703,046 | 11/1972 | Barone et al. | 42/94 |
| 4,026,057 | 5/1977 | Cady | 42/94 |
| 4,207,699 | 6/1980 | Hensley | 42/94 |
| 4,913,391 | 4/1990 | Klipp | 248/214 |
| 4,937,965 | 7/1990 | Narvaez | 42/94 |
| 5,081,782 | 1/1992 | Wright | 42/94 |
| 5,347,740 | 9/1994 | Rather et al. | 42/94 |
| 5,481,817 | 1/1996 | Parker | 248/286.1 |
| 5,491,919 | 2/1996 | Rather et al. | 42/94 |
| 5,815,974 | 10/1998 | Keng | 42/94 |

*Primary Examiner*—Charles T. Jordan
*Assistant Examiner*—Denise J Buckley
*Attorney, Agent, or Firm*—Joseph N. Breaux

[57] ABSTRACT

A truck mountable shooting rest that includes an attachment structure that is attachable to the bed wall of a pickup truck and a rifle support structure that is adjustably positionable by the user with respect to the attachment structure. The attachment structure includes a deformable friction insert sized to deformably friction fit into a bedwall hole of a pickup truck bedwall, a stop block formed at an end of the friction insert, and a support rod passageway formed through the friction insert and the stop block. The rifle support structure includes a rigid support rod having a threaded lower rod portion, a rod height adjustment nut assembly including a threaded adjustment nut threaded onto the lower threaded portion of the support rod and a nut entrapment structure secured to the top surface of the stop block such that the lower threaded portion of the support rod is directed into the support rod passageway, a curved rigid stock saddle attached to an upper rod end of the support rod, and a resilient stock rest cushion adhesively attached to a curved inner surface of the rigid stock saddle; the threaded adjustment nut being rotatable within the nut entrapment structure such that the curved rigid stock saddle is raised by rotation of the threaded adjustment nut in a first direction and lowered by rotation of the threaded adjustment nut in the opposite direction.

12 Claims, 2 Drawing Sheets

TRUCK MOUNTABLE SHOOTING REST

TECHNICAL FIELD

The present invention relates to shooting supports for supporting a rifle during firing and more particularly to a truck mountable shooting rest that includes an attachment structure that is attachable to the bed wall of a pickup truck and a rifle support structure that is adjustably positionable by the user with respect to the attachment structure; the attachment structure including a deformable friction insert sized to deformably friction fit into a bedwall hole of a pickup truck bedwall, a stop block formed at an end of the friction insert, and a support rod passageway formed through the friction insert and the stop block; the rifle support structure including a rigid support rod having a threaded lower rod portion, a rod height adjustment nut assembly including a threaded adjustment nut threaded onto the lower threaded portion of the support rod and a nut entrapment structure secured to the top surface of the stop block such that the lower threaded portion of the support rod is directed into the support rod passageway, a curved rigid stock saddle attached to an upper rod end of the support rod, and a resilient stock rest cushion adhesively attached to a curved inner surface of the rigid stock saddle; the threaded adjustment nut being rotatable within the nut entrapment structure such that the curved rigid stock saddle is raised by rotation of the threaded adjustment nut in a first direction and lowered by rotation of the threaded adjustment nut in the opposite direction.

BACKGROUND ART

It is often necessary to adjust the sights of the rifle when in the field. Although it can be necessary to adjust the sights of the rifle in the field, it can be difficult to accomplish the adjustment accurately because no stable rifle stock support is available. It would be a benefit, therefore, to have a truck mountable shooting rest that could be rapidly secured to the bedwall of a pickup truck and provide a stable support for supporting the rifle during the sight adjustment procedure. Because it can be necessary to adjust the height of the shooting rest prior to and during the sighting in process, it would be a benefit to have a shooting rest that included a height adjustment mechanism.

GENERAL SUMMARY DISCUSSION OF INVENTION

It is thus an object of the invention to provide a truck mountable shooting rest.

It is a further object of the invention to provide a truck mountable shooting rest that includes a height adjustment mechanism.

It is a still further object of the invention to provide a truck mountable shooting rest that includes an attachment structure that is attachable to the bed wall of a pickup truck and a rifle support structure that is adjustable positionable by the user with respect to the attachment structure; the attachment structure including a deformable friction insert sized to deformably friction fit into a bedwall hole of a pickup truck bedwall, a stop block formed at an end of the friction insert, and a support rod passageway formed through the friction insert and the stop block; the rifle support structure including a rigid support rod having a threaded lower rod portion, a rod height adjustment nut assembly including a threaded adjustment nut threaded onto the lower threaded portion of the support rod and a nut entrapment structure secured to the top surface of the stop block such that the lower threaded portion of the support rod is directed into the support rod passageway, a curved rigid stock saddle attached to an upper rod end of the support rod, and a resilient stock rest cushion adhesively attached to a curved inner surface of the rigid stock saddle; the threaded adjustment nut being rotatable within the nut entrapment structure such that the curved rigid stock saddle is raised by rotation of the threaded adjustment nut in a first direction and lowered by rotation of the threaded adjustment nut in the opposite direction.

It is a still further object of the invention to provide a truck mountable shooting rest that accomplishes some or all of the above objects in combination.

Accordingly, a truck mountable shooting rest is provided. The truck mountable shooting rest includes an attachment structure that is attachable to the bed wall of a pickup truck and a rifle support structure that is adjustable positionable by the user with respect to the attachment structure; the attachment structure including a deformable friction insert sized to deformably friction fit into a bedwall hole of a pickup truck bedwall, a stop block formed at an end of the friction insert, and a support rod passageway formed through the friction insert and the stop block; the rifle support structure including a rigid support rod having a threaded lower rod portion, a rod height adjustment nut assembly including a threaded adjustment nut threaded onto the lower threaded portion of the support rod and a nut entrapment structure secured to the top surface of the stop block such that the lower threaded portion of the support rod is directed into the support rod passageway, a curved rigid stock saddle attached to an upper rod end of the support rod, and a resilient stock rest cushion adhesively attached to a curved inner surface of the rigid stock saddle; the threaded adjustment nut being rotatable within the nut entrapment structure such that the curved rigid stock saddle is raised by rotation of the threaded adjustment nut in a first direction and lowered by rotation of the threaded adjustment nut in the opposite direction. The deformable insert can be formed of any deformable material, preferably resilient plastic or wood.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
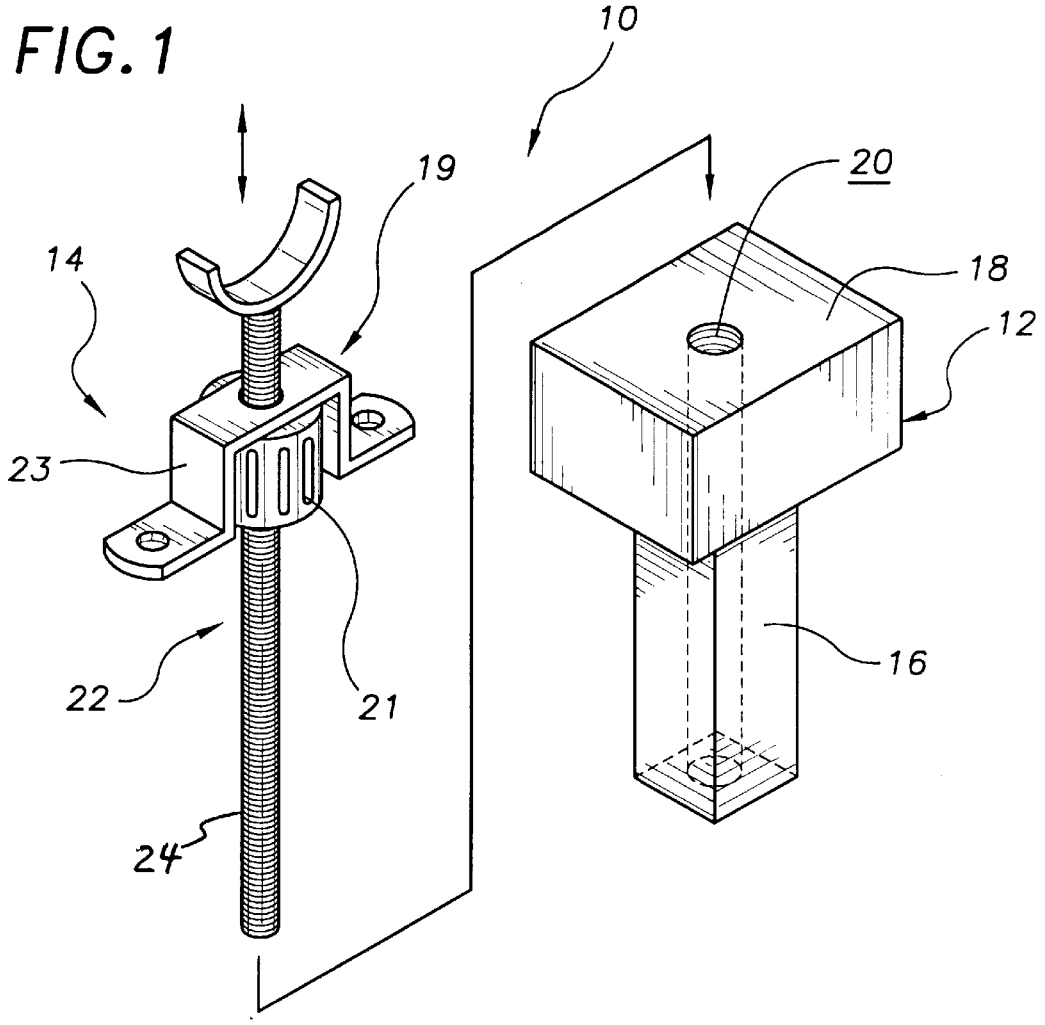
FIG. 1 is an exploded perspective view of an exemplary embodiment the truck mountable shooting rest of the present invention showing the attachment structure including the deformable friction insert, the stop block formed at an end of the friction insert, and the support rod passageway formed through the friction insert and the stop block; and the rifle support structure including the rigid support rod with the threaded lower rod portion, the rod height adjustment nut assembly including the threaded adjustment nut threaded onto the lower threaded portion of the support rod and the nut entrapment structure that is securable to the top surface of the stop block with the securing screws, the curved rigid stock saddle attached to the upper rod end of the support rod, and the resilient stock rest cushion adhesively attached to the curved inner surface of the rigid stock saddle.

FIG. 1 shows an exemplary embodiment the truck mountable shooting rest of the present invention, generally designated by the numeral 10. In this embodiment, truck mountable shooting rest 10 includes an attachment structure, generally designated 12, and a rifle support structure, generally designated 14. Attachment structure 12 is molded of resilient plastic and includes a deformable friction insert 16, a rectangular box shaped stop block 18 formed at an end of friction insert 16, and a support rod passageway 20 that is formed entirely through friction insert 16 and stop block 18.

Figure 2:
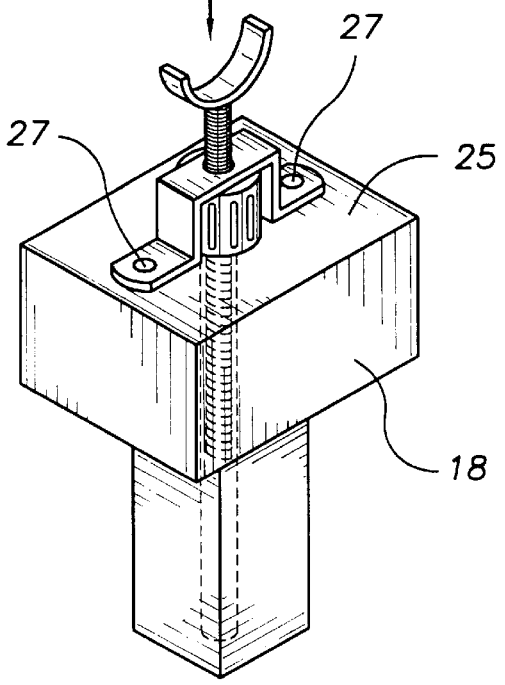
FIG. 2 is a perspective view of the truck mountable shooting rest of FIG. 1 showing the threaded lower rod portion of the support rod partially positioned into the support rod passageway formed through the friction insert and the stop block; and the rod height adjustment nut assembly secured to the top surface of the stop block with the securing screws.
Figure 2A:
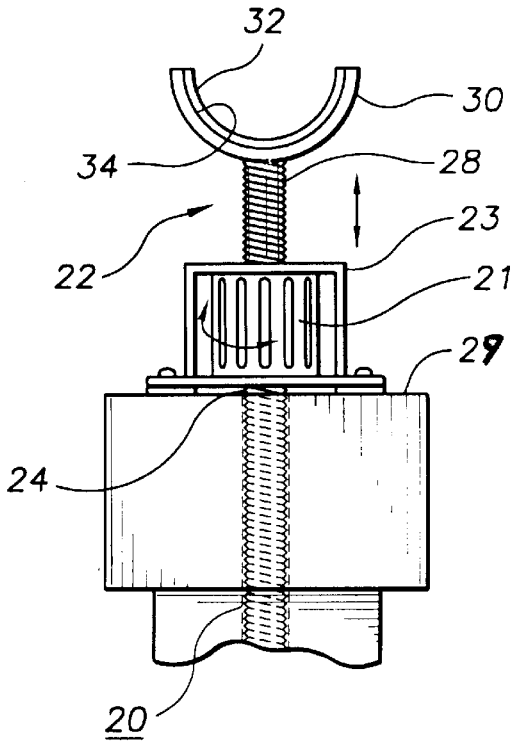
FIG. 2A is a side plan view of the truck mountable shooting rest of FIG. 1 showing the threaded lower rod portion of the support rod partially positioned into the support rod passageway formed through the friction insert and the stop block; and the rod height adjustment nut assembly secured to the top surface of the stop block with the securing screws.

Rifle support structure 14 includes a steel support rod, generally designated 22, having a threaded lower rod portion 24; and a rod height adjustment nut assembly, generally designated 19. Rod height adjustment nut assembly 19 includes a threaded adjustment nut 21 that is threaded onto threaded lower rod portion 24 and rotatable entrapped within a nut entrapment structure 23 that is, with reference now to FIG. 2, securable to a top surface 25 of stock block 18 with securing screws 27. With reference to FIG. 2A, nut entrapment structure 23 is secured to top surface 29 such that lower threaded portion 24 support rod 22 is directed into support rod passageway 20.

A curved, rigid steel stock saddle 30 is welded to the end of upper portion 28 and a resilient plastic stock rest cushion 32 is adhesively attached to a curved inner surface 34 of rigid stock saddle 30. Curved rigid stock saddle 30 is raised by rotation of threaded adjustment nut 21 in a clockwise direction and lowered by rotation of threaded adjustment nut in the opposite, counter-clockwise direction.

Figure 4:
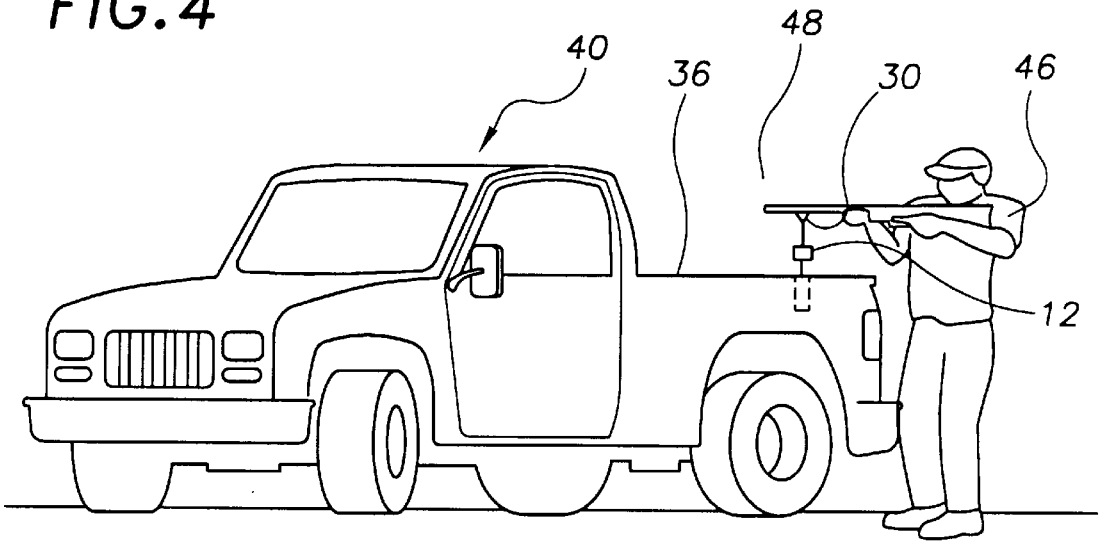
FIG. 4 is a perspective view showing the exemplary embodiment the truck mountable shooting rest of FIG. 1 in use with a representative pickup truck and rifle.
Figure 3:
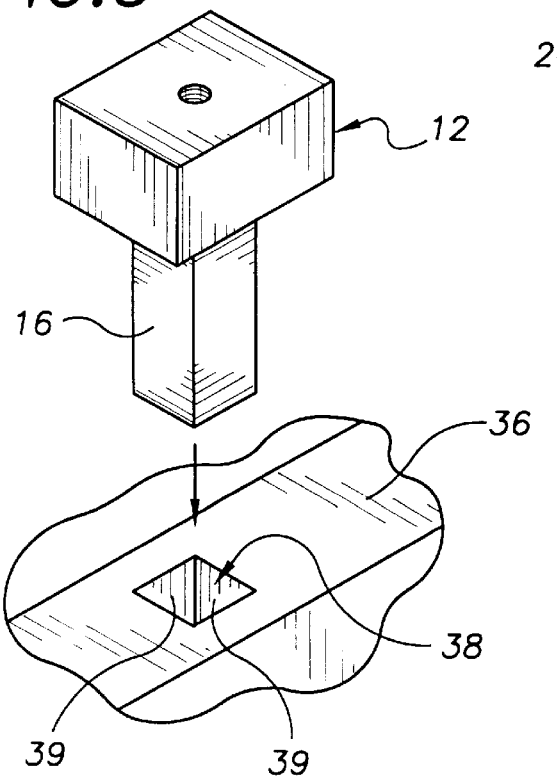
FIG. 3 is an exploded perspective view of the attachment structure positioned above the bed wall hole of a representative pickup truck prior to inserting the deformable friction insert into the bed wall hole.

With reference to FIG. 3, in use, attachment structure 12 is attached to the bed wall 36 of a pickup truck by inserting deformable friction insert 16 into one the bed wall holes 38 typically provided into the bedwalls of a pickup truck 40 (FIG. 4). Deformable friction insert 16 is sized such that it must be deformed to fit into bed wall hole 38 and frictionally grips the interior walls 39 that define bed wall hole 38 sufficiently to secure attachment structure 12 to bed wall 36.

With continued reference to FIG. 4, once attachment structure 12 is attached to bed wall 36 of a pickup truck 40, threaded adjustment nut 21 rotate in the required direction until rigid steel stock saddle 30 is positioned at the desired height. A user 46 can then rest the stock of a rifle 48 securely in stock saddle 30 while adjusting the sights of rifle 48 as needed.

It can be seen from the preceding description that a truck mountable shooting rest has been provided that includes a height adjustment mechanism; and that includes an attachment structure that is attachable to the bed wall of a pickup truck and a rifle support structure that is adjustably positionable by the user with respect to the attachment structure; the attachment structure including a deformable friction insert sized to deformably friction fit into a bedwall hole of a pickup truck bedwall, a stop block formed at an end of the friction insert, and a support rod passageway formed through the friction insert and the stop block; the rifle support structure including a rigid support rod having a threaded lower rod portion, a rod height adjustment nut assembly including a threaded adjustment nut threaded onto the lower threaded portion of the support rod and a nut entrapment structure secured to the top surface of the stop block such that the lower threaded portion of the support rod is directed into the support rod passageway, a curved rigid stock saddle attached to an upper rod end of the support rod, and a resilient stock rest cushion adhesively attached to a curved inner surface of the rigid stock saddle; the threaded adjustment nut being rotatable within the nut entrapment structure such that the curved rigid stock saddle is raised by rotation of the threaded adjustment nut in a first direction and lowered by rotation of the threaded adjustment nut in the opposite direction.

It is noted that the embodiment of the truck mountable shooting rest described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A truck mountable shooting rest comprising:

an attachment structure that is attachable to a bed wall of a pickup truck; and a rifle support structure that is adjustably positionable by a user with respect to said attachment structure;

said attachment structure including a deformable friction insert sized to deformably friction fit into a bedwall hole of a pickup truck bedwall, a stop block secured to an end of said friction insert, and a support rod passageway formed through said friction insert and said stop block;

said rifle support structure including a rigid support rod having a threaded lower rod portion, a rod height adjustment nut assembly including a threaded adjustment nut threaded onto said lower threaded portion of said support rod and a nut entrapment structure secured to a top surface of said stop block such that said lower threaded portion of said support rod is directed into said support rod passageway, a curved rigid stock saddle attached to an upper rod end of said support rod, and a resilient stock rest cushion adhesively attached to a curved inner surface of said rigid stock saddle;

said threaded adjustment nut being rotatable within said nut entrapment structure such that said curved rigid stock saddle is raised by rotation of said threaded adjustment nut in a first direction and lowered by rotation of said threaded adjustment nut in an opposite direction.

2. The truck mountable shooting rest of claim 1, wherein: said stop block is rectangular box shaped.

3. The truck mountable shooting rest of claim 1, wherein: said stop block is integrally formed with said end of said friction insert.

4. The truck mountable shooting rest of claim 1 wherein:

said deformable friction insert is molded of a resilient plastic.

5. The truck mountable shooting rest of claim 1 wherein:

said deformable insert is constructed of wood.

6. The truck mountable shooting rest of claim 2, wherein:

said stop block is integrally formed with said end of said friction insert.

7. The truck mountable shooting rest of claim 2 wherein:

said deformable friction insert is molded of a resilient plastic.

8. The truck mountable shooting rest of claim 2 wherein:

said deformable insert is constructed of wood.

9. The truck mountable shooting rest of claim 6 wherein:

said deformable friction insert is molded of a resilient plastic.

10. The truck mountable shooting rest of claim 6 wherein:

said deformable insert is constructed of wood.

11. The truck mountable shooting rest of claim 3 wherein:

said deformable friction insert is molded of a resilient plastic.

12. The truck mountable shooting rest of claim 3 wherein:

said deformable insert is constructed of wood.

* * * * *